United States Patent [19]

Russell

[11] Patent Number: 4,499,705

[45] Date of Patent: Feb. 19, 1985

[54] SEMI-AUTOMATIC INSERTION MACHINE FOR ENVELOPES

[75] Inventor: Robert J. Russell, Skokie, Ill.

[73] Assignee: Mail-Ex Corporation, Skokie, Ill.

[21] Appl. No.: 359,038

[22] Filed: Mar. 17, 1982

Related U.S. Application Data

[63] Continuation-in-part of Ser. No. 337,835, Jan. 7, 1982, , which is a continuation of Ser. No. 106,239, Dec. 21, 1979, abandoned, and Ser. No. 940,728, Sep. 7, 1978, abandoned.

[51] Int. Cl.[3] ..... B65B 7/00

[52] U.S. Cl. ..... 53/266 A; 53/386; 53/390; 53/391

[58] Field of Search ..... 53/206, 266 A, 266 R, 53/390, 391, 384, 386, 460

[56] References Cited

U.S. PATENT DOCUMENTS

| | | | |
|---|---|---|---|
| 1,960,959 | 5/1934 | Sague | 53/206 X |
| 2,569,219 | 9/1951 | Bamber et al. | 53/266 A X |
| 3,382,126 | 5/1968 | Hackmann | 53/266 A X |
| 3,410,053 | 11/1968 | Bonsch | 53/266 A |

FOREIGN PATENT DOCUMENTS

| | | | |
|---|---|---|---|
| 2749095 | 3/1979 | Fed. Rep. of Germany | 53/206 |
| 944255 | 12/1963 | United Kingdom | 53/206 |

*Primary Examiner*—James F. Coan

*Attorney, Agent, or Firm*—Trexler, Bushnell & Wolters, Ltd.

[57] ABSTRACT

The mechanism disclosed comprises a semi-automatic insertion machine for facilitating the insertion of contents into envelopes of the type utilizing exposed self-sealing adhesive.

The envelopes, with the seal flaps in open position and the adhesive exposed, are arranged in superposed relation within a supply hopper. Means is provided for removing the envelopes one by one from the supply hopper and transmitting them to the inserting station. The removal means for removing the envelopes from the supply hopper includes mechanisms for insuring that the envelopes shall not stick together due to the self-sealing adhesive, and for insuring that the envelopes shall be translated in one by one relationship to the inserting station.

At the inserting station the sidewalls of the envelope are drawn apart by suction gripping means, while the seal flap remains open and extended beneath a guide plate to facilitate the insertion of materials into the envelope by an operator.

After insertion, the envelope is again translated and during translation the seal flap is moved to closed position, and press sealed into place, and the envelope then translated to a receiving receptacle.

18 Claims, 11 Drawing Figures

SEMI-AUTOMATIC INSERTION MACHINE FOR ENVELOPES

BACKGROUND OF THE INVENTION

This application is a continuation-in-part of my prior application Ser. No. 337,835, SEMI-AUTOMATIC INSERTION MACHINE, filed Jan. 7, 1982, which is in turn a continuation of my prior application Ser. No. 106,239 filed Dec. 21, 1979, now abandoned, and Ser. No. 940,728 filed Sept. 7, 1978, now abandoned.

In said prior applications there is disclosed a semi-automatic insertion machine particularly adapted for facilitating the insertion of contents into envelopes of the type utilizing gummed seal flaps, wherein the gum is moistened and then the envelope flap is closed into contact with the adjacent envelope sidewall, and sealed into position. Envelopes of this type are normally received from the envelope manufacturer or supplier with the flaps closed but unsealed; and the envelopes are so disposed in superposed or stacked relation within the machine supply hopper. Such gum-flap envelopes are widely used, but the gum must be moistened when the envelope is used.

Forms of self-sealing envelopes are also used employing self-sealing adhesive wherein the adhesive is protected beneath a waxed cover strip or protected by reason of special envelope folding, but here also special operations are required when the envelope is used.

A still further form of envelope which has come into widespread use and to which the present invention is directed is the envelope of the self-sealing type wherein the adhesive is exposed. In this type of envelope there is a stripe or band of pressure sensitive adhesive carded or laid along the length of the envelope flap, with a similar band of adhesive being laid along the adjacent envelope sidewall in a manner so that the two bands are brought together when the envelope flap is closed. In this type envelope the adhesive used has an affinity for itself, so that when the bands are brought together the adhesive will adhere with a strong bond. The closing operation is simple.

However, a disadvantage here lies in the fact that the adhesives used may have a slight tackiness and/or sensitivity to pressure, so that the exposed adhesive tends inadvertently to adhere to surfaces to which no comating adhesive has been applied. Thus in the case of such envelopes, and particularly when they are disposed in superposed or stacked relation within a machine supply hopper or the like, they may inadvertantly tend to adhere or stick together, making separation difficult and unreliable in the case of an ordinary envelope handling machine.

In the machine of the present invention, means is provided to insure that there shall be a proper separation of the envelopes with exposed self-sealing adhesive, as they are withdrawn from the supply hopper for transmission to the inserting station of the machine. The envelopes are also handled in a manner, after they have been withdrawn from the supply hopper, so that during translation to the inserting station, and at the inserting station, and thereafter, until the seal-flap is closed, minimum difficulties are encountered with the envelope adhesive tending to adhere to machine surfaces or other surfaces against which the adhesive may become inadvertantly engaged.

The invention thus provides a machine for handling exposed adhesive self-sealing envelopes, and particularly a machine for facilitating the insertion of contents into such envelopes in an improved manner, minimizing the inherent difficulties encountered in handling envelopes of this self-sealing type.

In instances wherein the envelopes may be of such character that adhesive problems are not involved, the invention provides an improved machine for facilitating the insertion of materials into envelopes of the normally flap-open type.

OBJECTS OF THE INVENTION

It is an object of the present invention to provide a machine for handling envelopes of the exposed adhesive self-sealing type in an improved manner for processing.

More particularly, it is an object of the invention to provide an improved machine for handling envelopes of the exposed adhesive self-sealing type, for facilitating the insertion of materials into the envelopes by an operator at an inserting station.

Further, it is an object of the present invention to provide a machine for handling exposed adhesive self-sealing envelopes with minimal adherence of the envelopes to each other, or to other surfaces against which the envelopes may become inadvertantly engaged.

A still further object of the invention is to provide a machine for handling envelopes of the type utilizing an exposed self-sealing adhesive, and particularly for facilitating the insertion of contents into such envelopes, wherein the machine is more reliable and predictable in operation.

A further object of the invention is to provide a machine for processing envelopes of the normally flap open type in an improved manner regardless of how the adhesive may be disposed, and particularly to facilitate the insertion of materials therein.

Various other objects and advantages and features of the invention will appear from the following description of a preferred embodiment.

SUMMARY OF THE INVENTION

The machine comprises a supply hopper for receiving a stack of envelopes of the exposed adhesive self-sealing type, with the envelopes in superposed relation, and with the seal-flaps laying open and facing upwardly.

Suction means is provided for drawing the envelopes one by one downwardly from the bottom of the hopper; and divider means in the form of retractable plates is provided for isolating each envelope as it is withdrawn from the remaining envelopes in the stack so as to insure that only one envelope shall be withdrawn and transmitted to the processing station, which in the machine disclosed is a station for the inserting of contents into the envelope by an operator.

Means is provided for translating each envelope laterally as it is withdrawn from the bottom of the hopper, with the envelope seal flap extended, to an inserter station wherein the seal flap is brought beneath an inserter guide plate. At the inserter guide plate station, the envelope sidewalls are drawn apart by suction means so that materials may be projected or pushed by an operator across the top of the guide plate into the envelope between the open sidewalls. The suction means is then relaxed, permitting the envelope sidewalls to close.

The now filled envelope is again translated laterally, and during such translation fixed abutment means effect a partial closing of the open extended seal-flap, at least sufficient to cause the seal-flap to project substantially vertically upward from the plane of the envelope. A sealing sponge rubber presser roll is then brought into contact with the upwardly extending seal-flap, pressing it downwardly into engagement with the adjacent envelope sidewall to effect the seal-flap closing operation. The thus sealed envelope is then again translated laterally to a receiving hopper or receptacle.

DETAILED DESCRIPTION OF THE DISCLOSED EMBODIMENT

Figure 1:
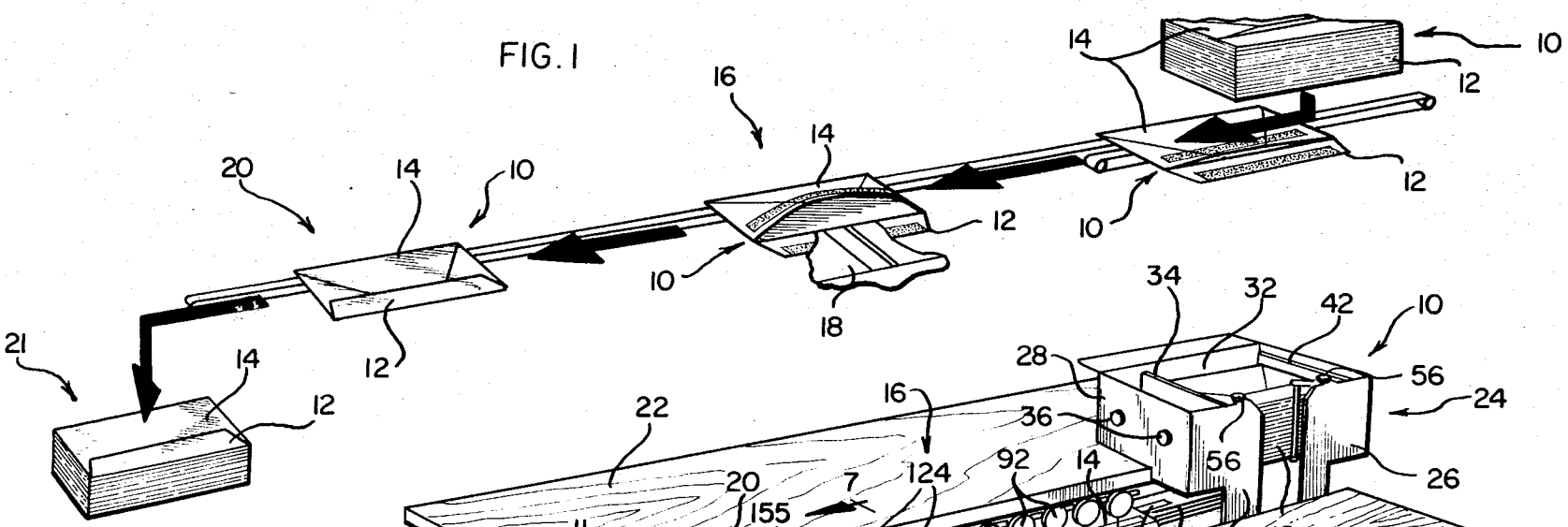
FIG. 1 is a flow through diagram indicating the manner in which envelopes are processed through the machine.

Referring to the flow diagram, FIG. 1, the envelopes 10 are initially shown as they are disposed within the hopper structure of the machine, laid in flat superposed or stacked relation, with the flap portion 12 thereof open and in extended position in respect to the envelope body 14.

As an envelope is withdrawn from the stack of the hopper it is translated to the left as seen in FIG. 1, in horizontal disposition, to an inserter or processing station generally indicated by the reference numeral 16. At the inserter station the extended envelope seal flap becomes trapped beneath an inserter guideplate, indicated by the reference numeral 18, and means is provided for drawing the sidewalls of the envelope apart so as to facilitate the insertion of contents into the envelope by an operator.

Thereafter the envelope is again translated to the left to a station generally indicated by the reference numeral 20, and during such translation the extending seal flap is partially closed, and brought into completely closed position at the station 20, after which the sealed envelopes may be suitably collected within a reservoir or receptacle station as indicated at 21.

Figure 2:
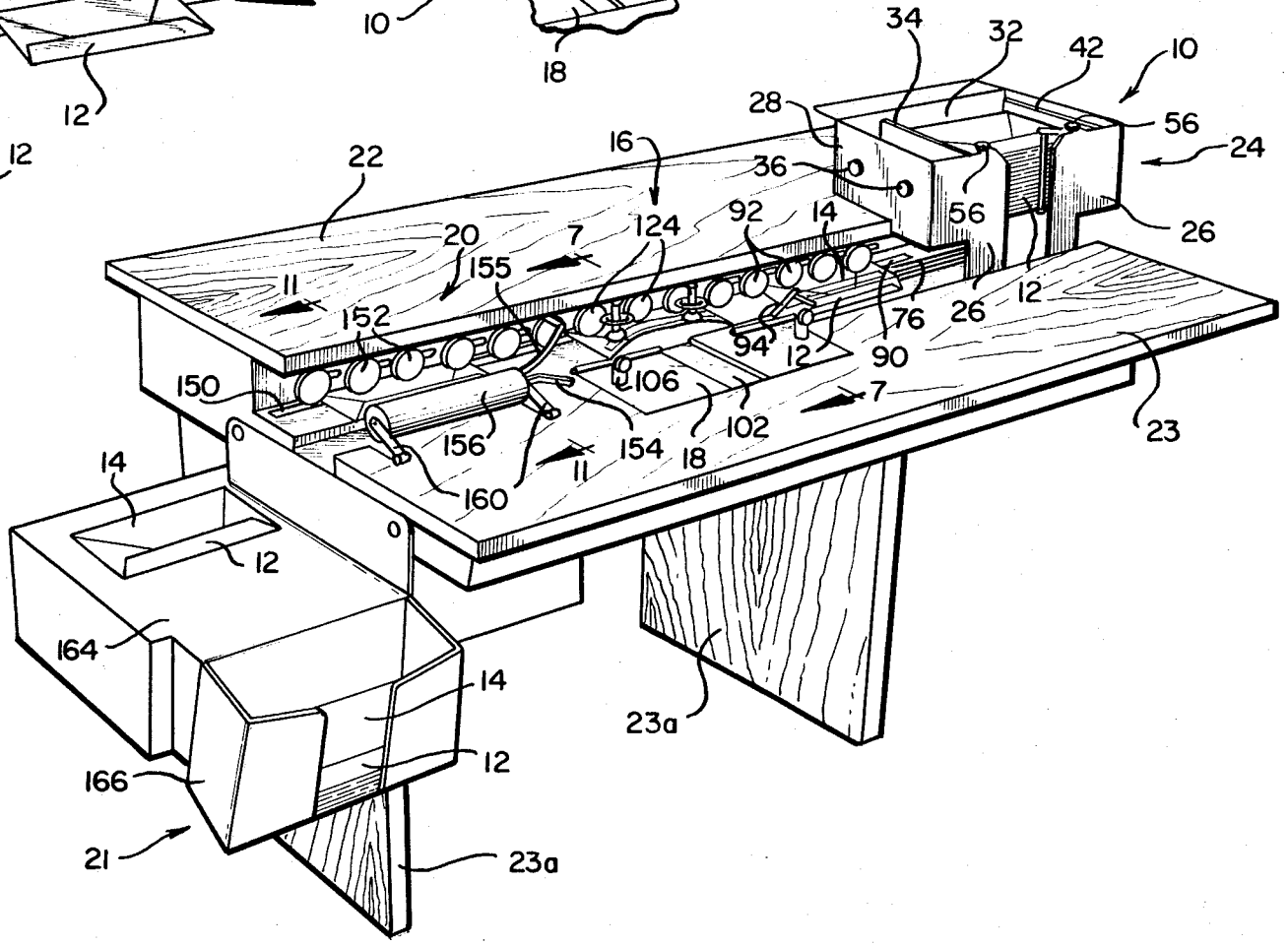
FIG. 2 is a perspective view of the machine of the present invention, in accordance with one preferred embodiment.

The general machine structure is shown in FIG. 2, and comprises a main frame having upper and lower table surfaces 22 and 23, supported by legs 23*a*.

Referring to FIG. 2, and to FIGS. 3–6, the hopper structure, generally indicated by the reference numeral 24, comprises a split front wall 26, side walls 28 and 30, and a rear wall 32.

Disposed within the hopper, in association with the hopper side wall 28, is an adjustable abutment plate 34 for engaging the envelope stack along one end face thereof, the adjustment of plate 34 being controlled by rotatable adjustment knobs 36 suitably carried upon rotatable shafts 38 having screw threaded adjustment with the hopper sideplate 28. The lower edge of plate 34 carries a foot 40 of sufficient size normally to support the weight of the envelope stack.

In a similar manner, in association with the opposite hopper side wall 30, there is an adjustable abutment plate 42 adjustable by knobs 44, and having a foot portion 46 for adjustable engagement and support of the envelopes at their other ends within the hopper stack. Plates 34 and 42 and their foot members 40 and 46, respectively, provide controllable means for supporting the ends of the envelope stack within the hopper.

Means is also provided for further supporting the envelope bodies and for adjustable abutment support for the envelope flaps. To this end the fixed hopper rear wall 32 is provided with a bottom foot portion 48, similar in character to the feet 40 and 46 previously described, and the front structure of the hopper is provided with a pair of depending abutment rods 50 and 52 carried respectively at the ends of arms 54 adjustable about pivot axes, and arranged to be locked in adjusted position by thumb nuts 56. Arms 54 may be adJusted about the axes of thumb nuts 56 to bring abutment rods 50 and 52 into proper engagement with the envelope end flaps within the hopper stack, and the thumb nuts 56 then operated to clamp the arms 54 in adjusted position.

Figure 3:
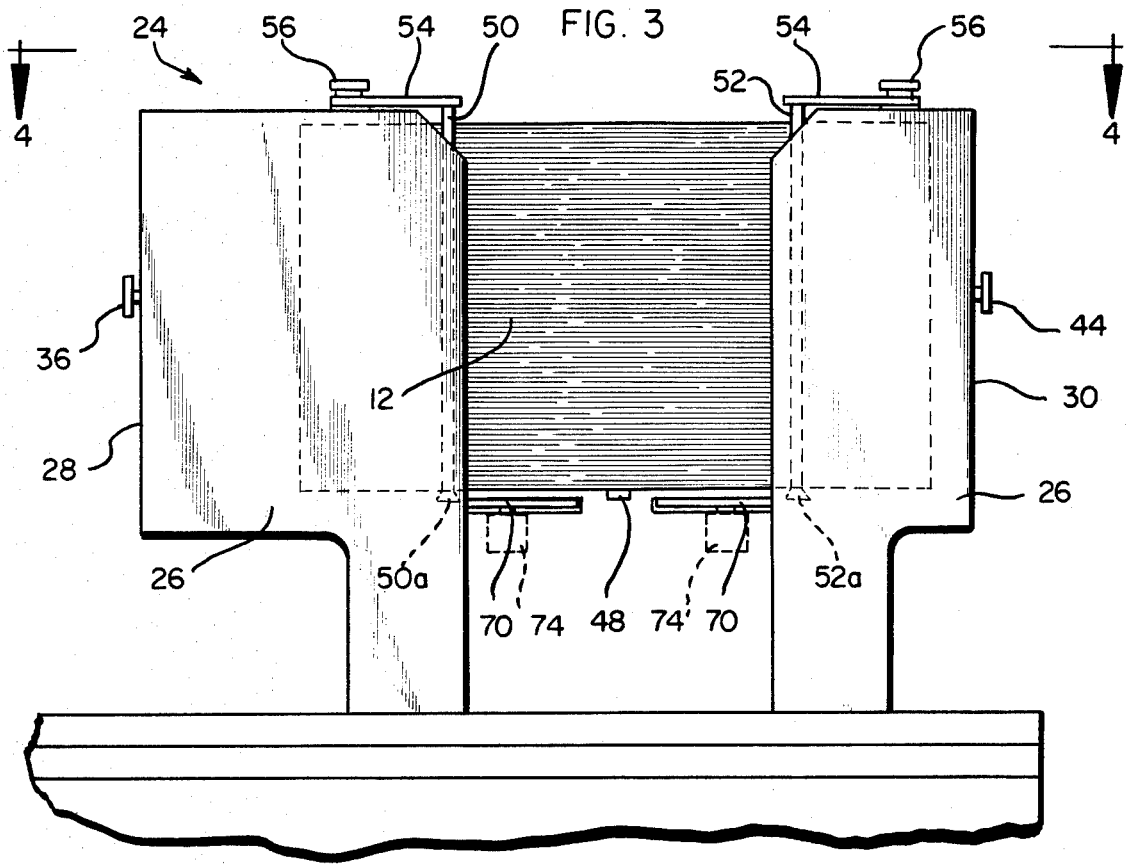
FIG. 3 is a front view of the hopper structure, shown to the right in FIG. 2, and constituting a part of the present invention.

Rods 50 and 52 carry enlarged foot portions 50*a* and 52*a* for providing vertical support to the envelope stack, as best shown in FIG. 3.

Figure 4:
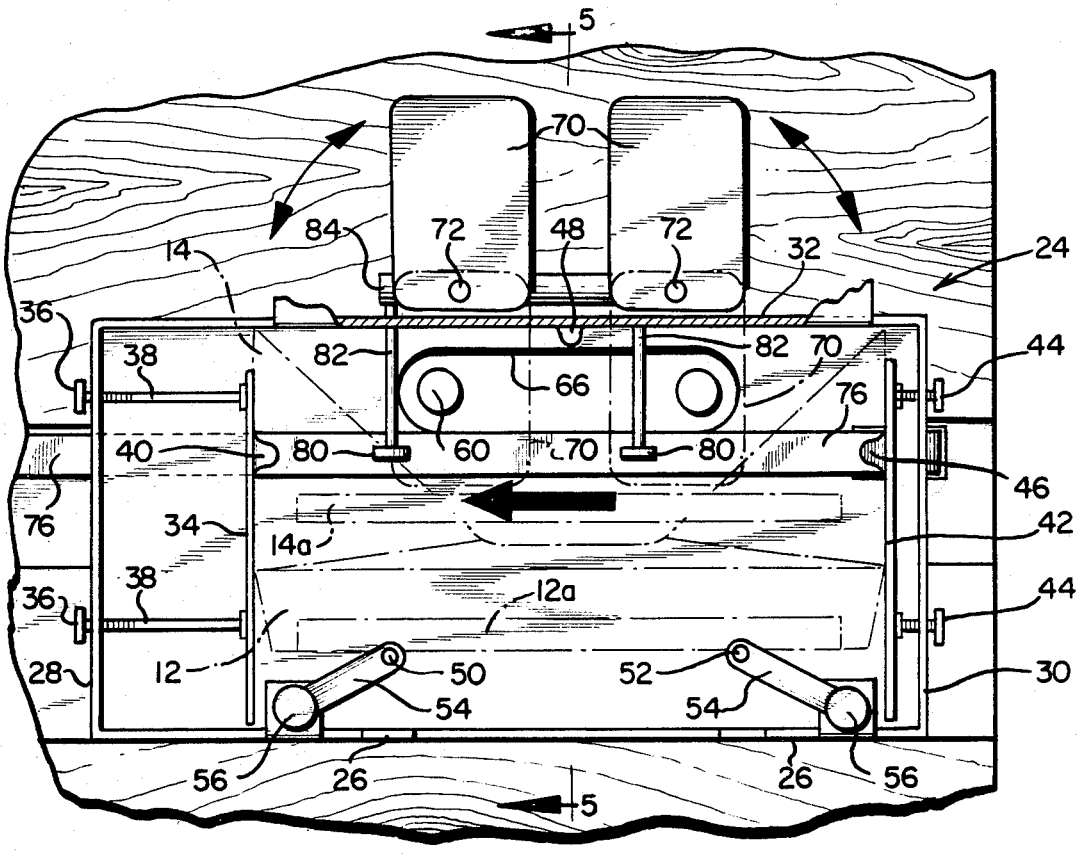
FIG. 4 is a horizontal view of the hopper structure, taken as indicated by the line 4—4 of FIG. 3.
Figure 6:
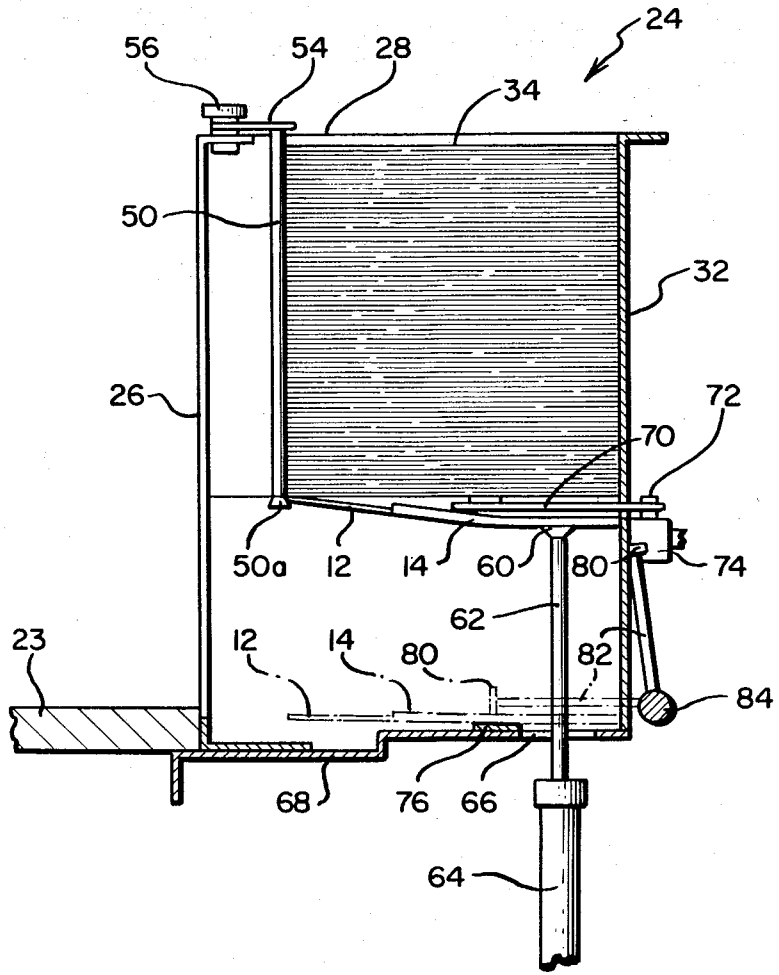
FIG. 6 is a view similar to FIG. 5, but showing certain of the operating parts in different position.
Figure 5:
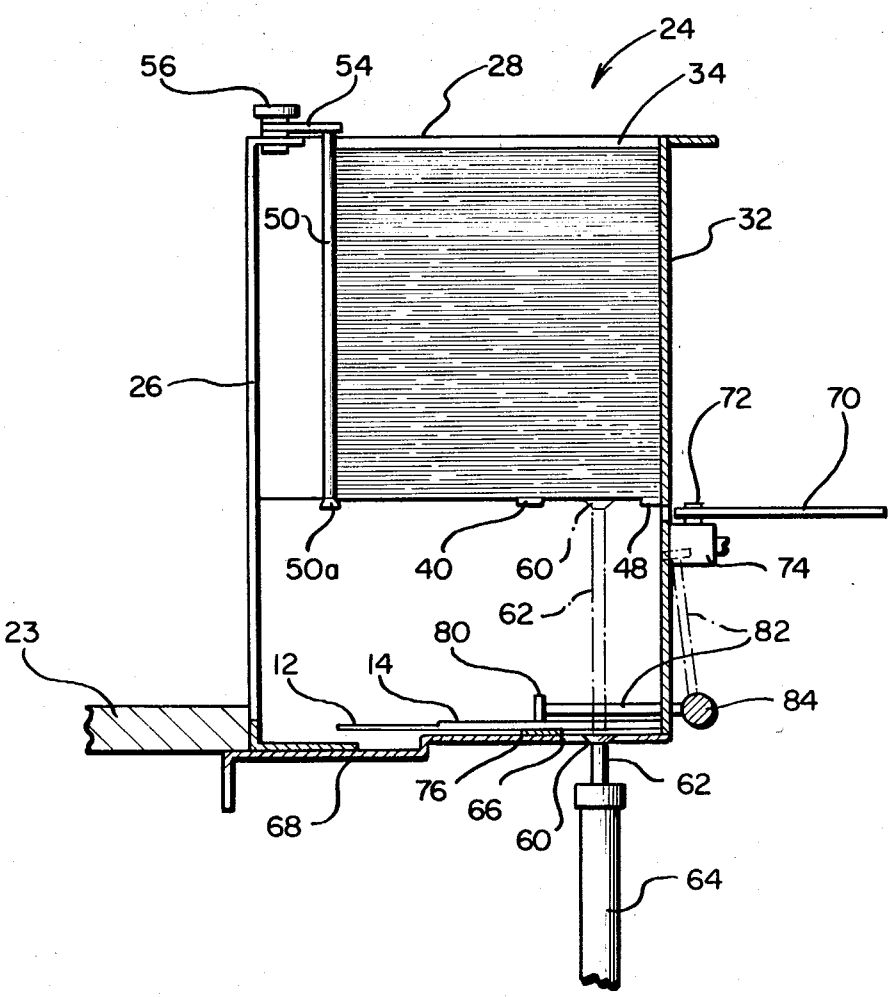
FIG. 5 is a vertical section of the hopper, taken as indicated by the line 5—5 of FIG. 4.

Means is provided for withdrawing a lowermost envelope from the envelope stack. As shown in FIGS. 4–6, a pair of reciprocable suction cups 60 is provided carried at the upper ends of piston rods 62 operable within cylinders 64, the piston rods being arranged for operation as a single unit in the operation of the machine. The piston rods and suction cups operate within an opening 66 in the bottom wall 68 of the hopper structure. In the operation of the machine, the cups are first brought into engagement with the lowermost envelope of the stack, as shown in the phantom lines in FIG. 5. Suction is applied to grip the lowermost envelope, and the cups are then moved downwardly to an intermediate position, as shown in FIG. 6.

While the envelope stack support means comprising the foot members 40, 46 and 48 will support the normal weight of the envelope stack, the suction in the cups 60 is sufficient to overcome the support means, causing the body portion 14 of the lowermost envelope of the stack to move into a downwardly displaced position, as shown in FIG. 6, for a purpose presently to be described.

As previously discussed in connection with the present invention, the handling of self-sealing envelopes of the exposed adhesive type presents particular and difficult problems. Due to the exposed adhesive, the envelopes tend to adhere to surfaces to which they may be inadvertantly engaged, and in particular the envelopes in stacked relation within the machine hopper, tend to stick to each other.

As shown in FIGS. 4–6, means is provided for overcoming such sticking problems, cooperable with the means and mechanisms previously described. As shown, a pair of plate members 70 is provided, rockable from a retracted position as shown in FIGS. 4 and 5, to a position as shown in FIG. 6, wherein the plate members are brought between the envelope stack and the lowermost withdrawn envelope when the suction cups are in the intermediate position shown in FIG. 6. The advanced position of the separater plates 70 is also shown in dotted lines in FIG. 4.

To effect the rotatable rocking movement of the plates 70 between the retracted full line position of FIG. 4 and the position of FIG. 5, to the advanced position as shown in dotted lines in FIG. 4 and as shown in FIG. 6, the plates are mounted respectively upon rock shafts 72, each shaft being operable from a gear box 74 upon which it is mounted.

In the operation of the machine, with the suction cups in the intermediate position shown in FIG. 6, the separater plates 70 are advanced to the position shown in FIG. 6, isolating the lowermost envelope, after which the suction cups are lowered to their completely lowermost postion, as shown in FIG. 5, to deposit the withdrawn envelope onto the surface of a shifter or transmission belt 76. The separater plates 70, in the advanced position shown in FIG. 6, preclude the envelopes within the stack from following down with the withdrawn envelope, as it is moved into the position of FIG. 5. After the withdrawn envelope has been laid onto the shifter or transmission belt 76, the suction in cups 60 is cut off, and the belt is put into motion to shift the withdrawn envelope to the left as seen in FIG. 2, and in the block diagram FIG. 1.

To insure that the envelope will be properly shifted as the shifter belt 76 moves, a pair of pressure rollers 80 is provided, also shown in FIGS. 4, 5 and 6. Rollers 80 are rotatably carried at the ends of arms or shafts 82 which are in turn mounted upon a rock shaft 84. The timing of the machine is such that rock shaft 84 is operated to bring the rollers 80 into engagement with the envelope upon the transmission belt 76, Just prior to the time that the belt moves, and as the suction in the now lowered suction cups 60 is cut off. After the withdrawn envelope has been shifted from the hopper, and to the left as seen in FIG. 2, rock shaft 84 is moved to bring the rollers 80 into the withdrawn or upright position as shown in FIG. 6, for clearance of the next envelope to be withdrawn upon upward and then downward movement of the suction cups 60.

In FIG. 4, the envelope bodies 14 and flaps 12 are shown in phantom lines, the upwardly exposed adhesive strip on the envelope body being indicated at 14*a*, and the corresponding exposed adhesive strip on the extending flap being indicated at 12*a*.

Reference is now made to FIG. 2, and to FIGS. 7–10. As the envelope is shifted to the left as seen in FIG. 2, it is initially translated by the transmission belt 76, from which it is transferred to a transmission belt 90 movable at the same time and at the same speed as belt 76. A series of pressure rollers 92, FIG. 2, insure that the envelope will move with belt 90 when the belt is in motion. It will be seen that the envelope is translated in the horizontal disposition, and it is translated first to an intermediate position, and then to the inserter station, in successive machine cycles.

Figure 7:
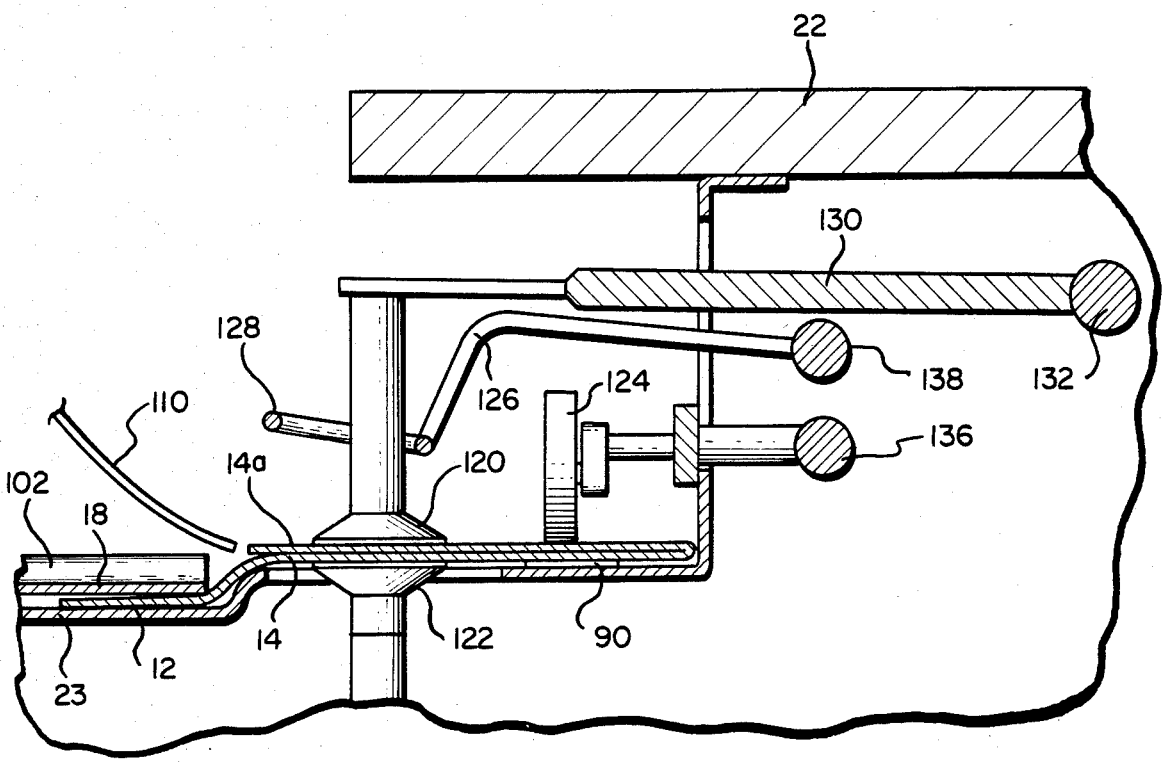
FIG. 7 is a partial sectional view, more particularly showing operating parts of the machine at the inserter station.
Figure 8:
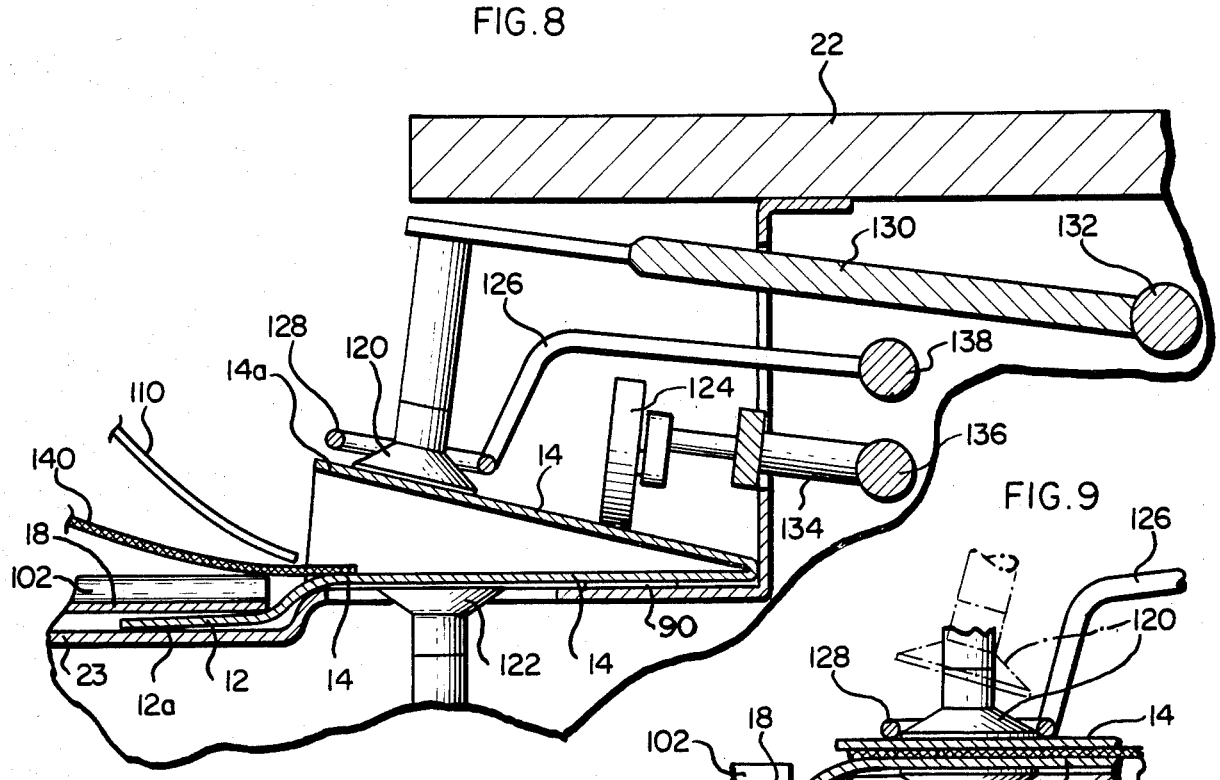
FIG. 8 is a view of the operating parts of FIG. 7, shown in a different position.
Figure 10:
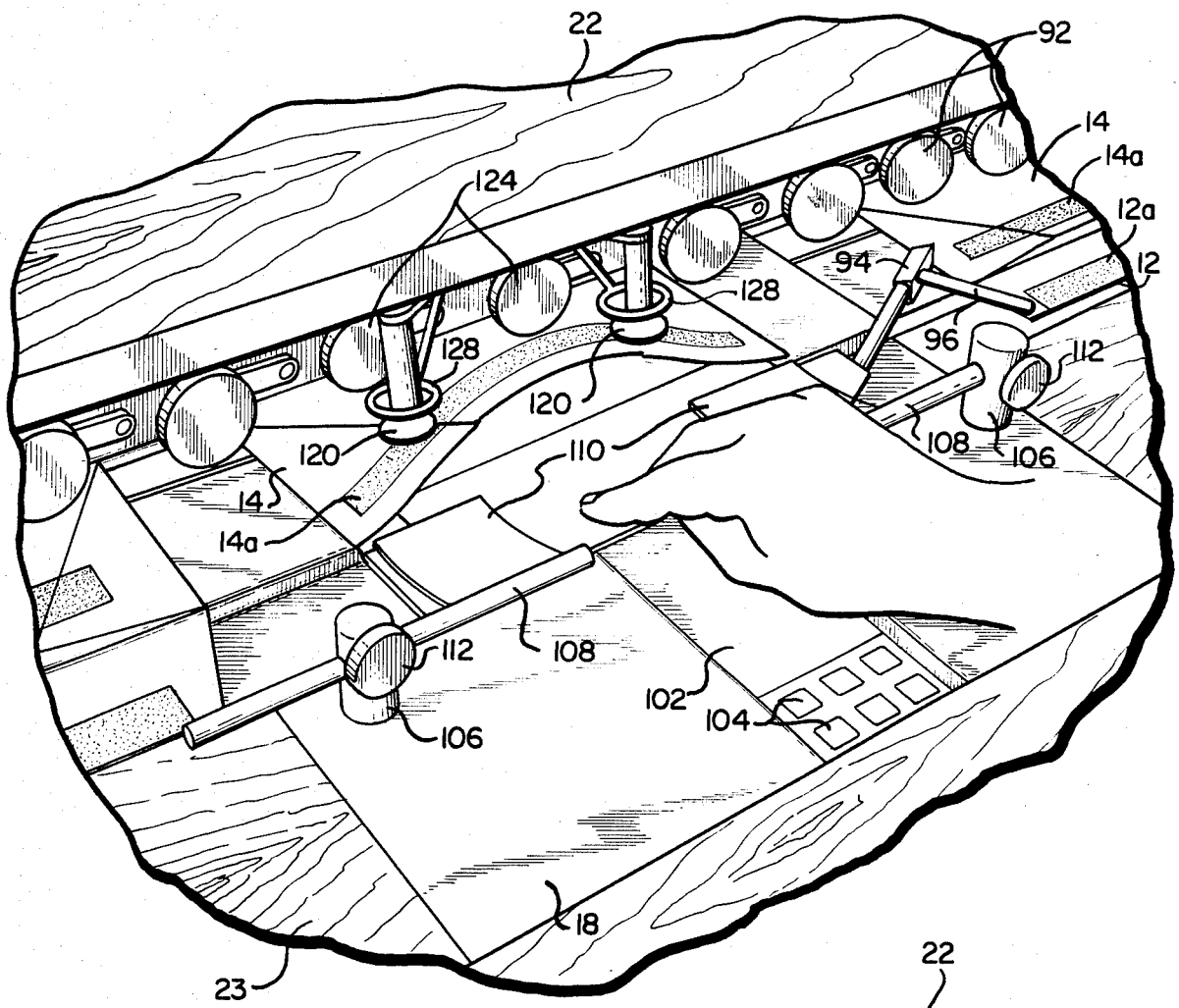
FIG. 10 is a perspective view of the parts at the inserter station.

As best shown in FIG. 10, a presser foot 94 having an auxiliary arm 96 is provided, engageable with the body of the envelope and with the extending flap 12 in a manner so as to ensure that the flap is brought beneath the inserter guide plate 18, horizontally disposed, and lying substantially in the plane of the lower table surface 23. However, the guide plate is disposed sufficiently above the plane of the table top, as shown in FIGS. 7 and 8, so as to allow the envelope flap to be brought therebetween.

The inserter plate is provided with a trough 102, to accommodate the operator's thumb, and control switches 104 are disposed within the trough, by means of which the operator may initiate a cycle of machine operation, after insertion of the envelope contents, or effect an emergency stop of the machine as the case may be. The inserter plate is further provided with a pair of posts 106 carrying arms 108 which in turn carry flexible plastic guide flaps 110 as an aid to the guiding of contents into the envelope by the operator. Arms or shafts 108 may be adjusted longitudinally and rotatably by means of thumb nuts 112.

At the inserter station the machine is provided with a pair of movable upper suction cups 120, a pair of stationary lower suction cups 122 aligned therewith when cups 120 are in lowered position, a pair of presser rolls 124, and a removal cage 126 formed with a pair of wire rings 128 at its outer end for a purpose presently to be described. Upper suction cups 120 may be raised and lowered by support arms 130 connected to a rock shaft 132. Presser rolls 124 may be raised and lowered by arms 134, secured to a rock shaft 136; and cage 126 is raised and lowered by reason of its connection to a rock shaft 138.

As an envelope is initially brought into the inserter station, transmission belt 90 is brought to a stop with the envelope essentially in the longitudinal position shown in FIG. 10. Presser rolls 124 are in their lower position, as shown in FIG. 7, to ensure proper control of the envelope by feed belt 90; whereas the upper suction cups 120 are in their upper position, as shown in FIG. 8, to permit the envelope properly to be brought into the inserter station. Wire cage 126 and removal rings 128 are also in upper position as shown in FIG. 8.

As the feed belt 90 is brought to a stop, upper cups 120 are lowered into the position shown in FIG. 7, and suction is applied to both sets of suction cups to grip the envelope side walls. Upper cups 120 are then raised to the position of FIG. 8, to open the envelope, and presser rolls 124 are simultaneously lifted to the FIG. 8 position to permit the envelope to open. The envelope contents to be inserted, indicated by the reference numeral 140 in FIG. 8, may then be inserted by the operator into the envelope.

Figure 9:
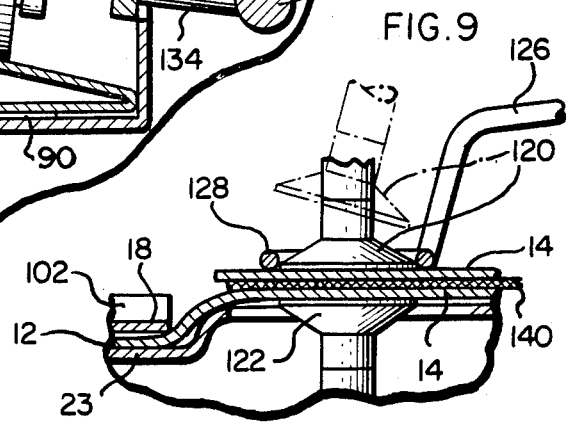
FIG. 9 is a partial detail of the operating parts of FIGS. 7 and 8.

As the next machine cycle is then initiated by the operator, upper suction cups 120 and presser rolls 124 are lowered to their position as shown in FIG. 7, and removal rings 128 are also moved to lowered position, as shown in FIG. 9. Suction to the suction cups is then turned off, and cups 120 are again raised, but removal rings 128 remain in lowered position, ensuring that the envelope will be stripped from the upper suction cups as they are retracted. More particularly, it will be noted that the upper suction cups may engage the envelope sidewall on or in the vicinity of the adhesive strip 14*a*. Adhesive tends to build up and adhere to the upper suction cups. Removal rings 128 thus ensure proper operation, and after the upper suction cups have been lifted to the dotted line position shown in FIG. 9, the stripper rings 128 are raised.

Figure 11:
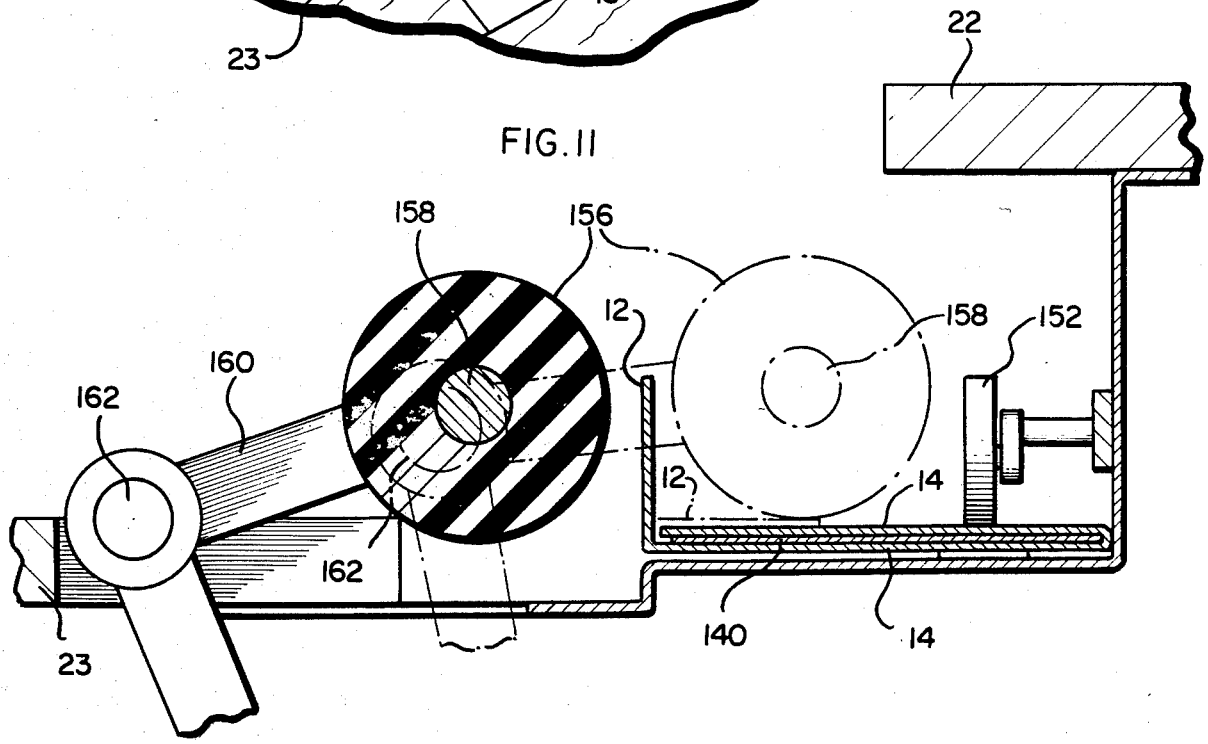
FIG. 11 is a partial sectional view of operating parts of the machine operable upon the envelope to close it after insertion of the envelope contents, taken as indicated by the line 11—11 of FIG. 2.

Resumed operation of feed belt 90 now shifts the filled envelope again to the left, as seen in FIG. 2, tranferring it to a further feed belt 150, having cooperative presser rolls 152, as seen in FIG. 2. The envelope is thus brought to the seal-flap closing station 20, and during such transmission, the seal-flap, as it moves out from under the inserter guide plate 18, is engaged by a finger abutment 154, FIG. 2, which partially closes the seal-flap, sufficient to bring it into an upstanding position as illustrated in FIG. 11. A flexible wiper member 155 simultaneously engages and stabilizes the envelope body. Transmission belt 150 then stops and thus deposits the envelope at the seal-flap closing station with the seal flap upstanding, as shown in FIG. 11.

At the seal-flap closing station there is provided an elongated soft rubber roller 156 rotatably mounted upon a shaft 158 carried by a pair of arms 160 mounted on a shaft 162, shiftable between the whole line and phantom line positions indicated in FIG. 11. After the envelope is brought to a stop at the flap closing position, rubber roller 156 is projected forwardly or to the right as seen in FIG. 11, engaging the upstanding seal-flap 12, and compressing it downwardly to the phantom position as seen in FIG. 11 to effect the closing of the seal flap by contact adhesion of the self-sealing adhesive on the seal-flap and envelope body.

Transmission belt 150 is then again started to remove the sealed envelope for deposit onto a table 164 with which is associated a receiving receptacle 166.

SUMMARY OF OPERATION

In the operation of the machine, envelopes which may be of the seal flap open exposed adhesive type, are deposited as a stack into the hopper 24 of the machine, with the seal flaps open, and the adhesive upwardly exposed both in a stripe or band upon the seal flap and upon the adjacent envelope sidewall. The support feet 40, 46, 48 50*a* and 52*a* of the hopper support the weight of the envelope stack. Suction cups 60 are raised and shift the lowermost envelope sufficiently downward, as seen in FIG. 6, to permit separater plates 70 to be shifted into position, also as seen in FIG. 6, to inhibit downward movement of other envelopes in the envelope stack as the lowermost envelope is removed.

The thus removed envelope is deposited upon the transmission belt 76, which under the action of the presser rolls 80 insures that the envelope will be properly translated from the hopper structure as the transmission belt is moved.

The removed envelope is transmitted first to an intermediate station between the hopper and the inserter station, and upon the next cycle of operation of the feed belt is transmitted to position at the inserter station. As the envelope moves to the inserter station the extended seal flap is brought beneath the inserter guide plate 18.

After the envelope has been brought to rest, upper suction cups 120, FIG. 8, are lowered, suction is applied, and the suction cups are then raised to move the envelope sidewalls apart as shown in FIG. 8 to facilitate insertion of envelope contents by the operator.

At the inserter station stripper rings 128 insure that the envelope shall not inadvertantly adhere to the upper suction cups.

After insertion of envelope contents at the inserter station, the envelope is translated by renewed movement of the transmission belts to the flap closing station, and during such transmission the envelope flap is partially closed by abutment finger 154, and thereafter completely closed by the rubber roller 156.

The machine provides an advantageous mechanism for inserting envelope contents into and for thereafter closing the seal flaps of normally flap open type envelopes. In instances wherein exposed sealing adhesive is used, the machine provides mechanisms for insuring proper movement of the envelopes and for precluding the inadvertant sticking thereof while in the hopper, or at the inserter station, or elsewhere through the progress of the machine.

The invention is hereby claimed as follows:

1. A machine for facilitating the manual insertion of materials by an operator into envelopes of the type having a body and an adjacent seal flap provided with exposed self-sealing adhesive, said machine comprising: a hopper for receiving a quantity of envelopes and including means normally supporting the envelopes in stacked relation with the envelope seal flaps in superposed extended position, means for withdrawing envelopes in one by one relationship from the hopper, means independent of said normal stack supporting means and separately engageable with the envelope stack as additional support therefor for inhibiting removal of remaining envelopes in the hopper as each envelope is withdrawn, an inserter station, means for translating each envelope withdrawn from the hopper to the inserter station, means at the inserter station for separating the envelope side walls to facilitate the introduction of materials into the envelope, a guide plate at the inserter station for guiding materials into the envelope, translating means for removing a filled envelope from the inserter station, and flap closing means operable upoh the filled envelope for sealing the flap onto the adjacent envelope side wall.

2. An insertion machine as defined in claim 1 wherein said hopper withdrawing means comprises a pair of suction cups engageable with spaced body portions of the envelopes.

3. An insertion machine as defined in claim 1 wherein said hopper inhibiting means comprises a plate member movable into the hopper between the withdrawn envelope and the remainder of the envelope stack.

4. An insertion machine as defined in claim 1 wherein said hopper withdrawing means comprises a suction cup engageable with the body portion of the envelope, and said hopper inhibiting means comprises a plate member movable into the hopper between the withdrawn envelope and the remainder of the envelope stack.

5. An insertion machine as defined in claim 1 wherein the separating means at the inserter station comprises a pair of suction cups respectively engageable with the side walls of the envelope.

6. An insertion machine as defined in claim 5 wherein stripper means is provided for stripping the envelope from at least one of said cups.

7. An insertion machine as defined in claim 1 wherein said flap closing means includes a roller engageable with the envelope flap for rolling it into engagement with the adjacent envelope side wall.

8. An insertion machine as defined in claim 1 wherein said flap closing means comprises an abutment engageable with the envelope flap during envelope translation to partially close said flap, and a roller engageable with the flap thereafter for rolling it into engagement with the adjacent envelope side wall.

9. A machine for facilitating the manual insertion of materials by an operator into envelopes of the type having a body and a normally open extending seal flap, said machine comprising: a hopper for receiving a quantity of envelopes and including means normally supporting the envelopes in stacked relation with the envelope seal flaps in superposed extended position, means for withdrawing envelopes in one by one relationship from the hopper, means independent of said normal stack supporting means and movable into additional stack supporting position engaging the next adjacent envelope in the stack during each one by one envelope withdrawal from the stack, an inserter station having an inserter guide plate, translating means for translating each withdrawn envelope from the hopper in substantially horizontal disposition to bring the extended seal flap into position beneath the guide plate, means at the guide plate station to separate the envelope side walls to facilitate the introduction of materials across the face of the guide plate into the envelope, translating means for removing the filled envelope from the guide plate station, and flap closing means for closing the envelope flap upon operation of said last named translating means.

10. A machine as defined in claim 9 wherein said flap closing means comprises an abutment against which the flap is engaged during operation of the translating means.

11. A machine as defined in claim 9 wherein the independent support means includes a plate member engaging the next adjacent envelope in the stack during each one by one envelope withdrawal from the stack.

12. A machine for facilitating the manual insertion of materials by an operator into envelopes of the type having a body and an adjacent seal flap provided with exposed self-sealing adhesive, said machine comprising: a hopper for receiving and having stationary means normally supporting a quantity of envelopes in stacked relation with the envelope seal flaps in any exposed extended position, means for withdrawing envelopes in one by one relationship from the hopper, means interposable between the envelope being withdrawn and the adjacent envelope in the stack for additionally supporting the stack during each envelope withdrawal and inhibiting adherence between the superposed seal flaps, an inserter station, means for translating each envelope withdrawn from the hopper to the inserter station, means at the inserter station for separating the envelope side walls to facilitate the introduction of materials into the envelope, translating means for removing a filled envelope from the inserter station, and flap closing means operable upon the filled envelope for sealing the flap onto the adjacent envelope side wall.

13. A machine as defined in claim 12 wherein the additional stack supporting means is removed from stack support upon completion of each envelope removal by the envelope withdrawing means.

14. A machine as defined in claim 13 wherein the additional stack supporting means comprises a plate member.

15. A machine as defined in claim 12 wherein the stationary stack supporting means engages the envelope stack at marginal Portions thereof and wherein the additional stack supporting means engages the stack within the marginal support thereof.

16. A machine as defined in claim 15 wherein the additional stack supporting means engages the envelope stack in closer proximity to the seal flaps than the stationary supporting means to assist in preventing adherence between the seal flaps as the envelopes are withdrawn in one by one relationship.

17. A machine for facilitating the manual insertion of materials by an operator into envelopes of the type having a body and an adjacent seal flap provided with exposed self-sealing adhesive, said machine comprising: a hopper for receiving a quantity of envelopes in stacked relation with the envelope seal flaps in superposed extended position, means for withdrawing envelopes in one by one relationship from the hopper, means for inhibiting removal of remaining envelopes in the hopper as each envelope is withdrawn, an inserter station, means for translating each envelope withdrawn from the hopper to the inserter station, means at the inserter station including a pair of suction cups respectively engageable with the side walls of the envelope for separating the envelope side walls to facilitate the introduction of materials into the envelope, a guide plate at the inserter station for guiding materials into the envelope, stripper means for stripping the envelope from at least one of said cups, translating means for removing a filled envelope from the inserter station, and flap closing means operable upon the filled envelope for sealing the flap onto the adjacent envelope side wall.

18. A machine for facilitating the manual insertion of materials by an operator into envelopes of the type having a body and an adjacent seal flap provided with exposed self-sealing adhesive, said machine comprising: a hopper for receiving a quantity of envelopes in stacked relation with the envelope seal flaps in superposed extended position, means for withdrawing envelopes in one by one relationship from the hopper, means for inhibiting removal of remaining envelopes in the hopper as each envelope is withdrawn, an inserter station, means for translating each envelope withdrawn from the hopper to the inserter station, means at the inserter station for separating the envelope side walls to facilitate the introduction of materials into the envelope, a guide plate at the inserter station for guiding materials into the envelope, translating means for removing a filled envelope from the inserter station, and flap closing means operable upon the filled envelope for sealing the flap onto the adjacent envelope side wall and comprising an abutment engageable with the envelope flap during envelope translation to partially close said flap, and a roller engageable with the flap thereafter for rolling it into engagement with the adjacent envelope side wall.

* * * * *